United States Patent [19]

Adnyana et al.

[11] Patent Number: 4,840,346

[45] **Date of Patent: * Jun. 20, 1989**

[54] APPARATUS FOR SEALING A WELL BLOWOUT

[75] Inventors: Dewa N. Adnyana, Stamford; Neil E. Rogen, Westport, both of Conn.

[73] Assignee: Memory Metals, Inc., Norwalk, Conn.

[ * ] Notice: The portion of the term of this patent subsequent to Oct. 28, 2003 has been disclaimed.

[21] Appl. No.: 721,957

[22] Filed: Apr. 11, 1985

[51] Int. Cl.[4] ..... E21B 33/06

[52] U.S. Cl. ..... 251/1.3; 251/1.1; 251/333; 60/528; 166/363

[58] Field of Search ..... 251/1 R, 1 A, 94, 116, 251/327-329, 333; 310/306, 307; 166/55, 363, 364; 318/117; 60/527, 528; 92/19, 21 R, 23

[56] References Cited

U.S. PATENT DOCUMENTS

| | | | |
|---|---|---|---|
| 1,512,837 | 10/1924 | Evenden | 92/19 |
| 2,056,543 | 10/1936 | Tschappat | 251/1 A X |
| 2,162,990 | 6/1939 | Abescrombie et al. | 251/1 A |
| 3,319,923 | 5/1967 | Haeber et al. | 251/1 A |
| 3,403,238 | 9/1968 | Buehles et al. | 337/393 |
| 3,941,141 | 3/1976 | Robert | 137/1 |
| 4,472,113 | 9/1984 | Rogen | 417/321 |
| 4,524,343 | 6/1985 | Morgan et al. | 337/140 |

*Primary Examiner*—Samuel Scott
*Assistant Examiner*—Allen J. Flanigan
*Attorney, Agent, or Firm*—Jerry Cohen; William E. Noonan

[57] ABSTRACT

An apparatus $T_1$ for sealing a well tubing 12 including a housing 20, 21, 22 which has a channel 68 communicating with the bore of tubing 12 and a chamber 43 connected with channel 68. A seal 62 is slidably mounted in the housing and is disposed in a retracted open condition in chamber 43 to enable fluid flow through channel 68. AN actuator 41, 42 also disposed in chamber 43, includes a shape memory alloy material which is responsive to the temperature thereof rising to a predetermined level corresponding to the transition temperature of the shape memory alloy for transforming in shape to extend the seal into an extended condition within channel 68, thereby blocking fluid flow therethrough.

24 Claims, 5 Drawing Sheets

APPARATUS FOR SEALING A WELL BLOWOUT

BACKGROUND OF THE INVENTION

The present invention relates generally to a well apparatus for use in controlling the flow of fluids within the well. In particular, the present invention relates to means for stopping the uncontrolled flow of fluids from a well blowout during drilling or production of oil and gas.

In the drilling or production of oil and gas, accidents such as equipment malfunctions or the like occasionaly result in a condition known as a blowout. In such instances, the fluids under substantial underground pressure flow uncontrollably to the surface, i.e. a sea floor or a land surface. Often when such uncontrolled well flow occurs, the combustible fluids leaving the wellhead are ignited, causing a fire.

Well blowouts should be capped as quickly as possible in order to prevent a further loss of the valuable resource, as well as to prevent pollution of the environment. However, to control the flow from a burning or damaged well, it is necessary to close the wellbore at a location where the casing and tubing are stillundamaged and accessible.

In one commonly used method, additional wellbores are drilled to intersect the uncontrolled wellbore so that a plugging fluid such as cement, a heavy drilling mud or the like can be pumped into the formation to kill the well. Another method uses explosives to blow out the fire and subsequently seal off the well at the surface wellhead. These procedures, however, are hazardous, costly and time consuming and also permit the well effluents to flow onto and pollute the surrounding area. Even after the combustion is stopped, the capping operation remains extremely dangerous in that the highly combustible effluents may ignite at any time. Moreover, in offshore operation, heavy wave action may severely limit the operation and can also appreciably increase the danger of the operation.

Another method for extinguishing the uncontrolled flow of fluids is described in U.S. Pat. No. 2,000,381. This technique includes the construction of an underground cage in which flow control devices are located and controlled via a tunnel leading from the surface to the cage. The technique also includes the application of a piercing means whereby the well casing and production tubing string may be pierced so that fire-quenching steam or other fluid or gas can be supplied to extinguish the burning well. Another underground method of closing the well is disclosed in U.S. Pat. No. 3,277,964, wherein two or three tunnels are directed to the location adjacent to the undamaged wellhead. The technique also includes a tapping process which is carried out at the lower part of the production tubing, followed by forming a crimp in the upper production tubing. The forming process may use a pair of hydraulic rams. Thereafter, the discharge is bled and plugging material is injected into the well. To complete the operation, both of the aforesaid techniques often require personnel to go down along the tunnel to install the equipment on the wellhead. Both operations are therefore considered to be dangerous, especially in underwater wells in offshore operations. Furthermore, the operations are very costly and time consuming.

In offshore operations, various techniques are known for the purpose of closing off the underwater well against the uncontrolled discharge of gas or oil from the well. For example, U.S. Pat. No. 3,631,928 shows an apparatus and method for drilling into the well casing and closing the well by pumping mud or cement into the well. The drilling process is usually done by sending a diver down to the wellhead at the ocean floor. Similarly, in U.S. Pat. No. 3,647,000 divers are sent to the location below the water surface at the wellhead in order to restrict the effluence flow by crimping the casing walls and introducing materials which form a plug beneath the restriction and stop the effluent flow. The method shown in U.S. Pat. No. 4,163,477 includes a shut-off device which is activated by a gas generator. The gas generator is brought down by a diver to the ocean floor and remote control of the activation point is provided. These methods, however, are costly and time consuming. Moreover, sending a diver down below the water surface is dangerous since debris from above may fall on him. Further, fallen debris may impede the diver's access to the wellhead or the control console and may cause him to mishandle the equipment. Heavy wave action may also severely limit closing operation by the diver and can also appreciably increase the danger of the operation.

U.S. Pat. Nos. 3,405,387 and 3,590,920 use sound waves and radio waves, respectively, to activate underwater well control devices for use in closing off the uncontrolled well. Such devices, however, may be easily triggered by false or inadvertant signals.

There are other examples of shut-off devices in the prior art which are remote controlled utilizing a hydraulic control system. Fluid is pressurized and pumped into the hydraulic control line to close the valves or rams. Examples of such devices are shown in U.S. Pat. Nos. 3,512,554; 3,926,256 and 4,193,574. In hydraulically controlled shut-off devices, however, a certain disadvantage is present in that the hydraulic control line leading to the shut-off device may be damaged, or corroded, or otherwise leak to permit reduction of the hydraulic control pressure, thereby causing the device not to close properly. These problems are frequently found in the hydraulic control line for underwater operation. Another disadvantage of the use of hydraulically controlled shut-off devices is that extremely high hydraulic control pressures are sometimes required. This means that hydraulic control lines at the surface must carry high hydraulic pressure. These high hydraulic control pressures constitute a potential hazard to personnel working on the platform and/or around the control console.

U.K. Pat. No. 2,091,321A discloses a method for use in closing off an uncontrolled blowout of underwater wells. The method is carried out by positioning an apparatus comprising slidable base means, including support means for positioning a pipe engaging means and a pipe straightener means, above the uncontrolled wellbore. The operation includes passing a continuous pipe into the wellbore through the slidable base means to near the bottom of the wellbore. Thereafter, a plugging material is pumped into the wellbore to control and kill the well. Due to construction of the system and operating characteristics, there are some limitations confronting the operator which make it difficult to properly install the slidable base means around the wellhead. Moreover, the apparatus is not suitable for the control of fluid flow from wells which are burning. Further, this method is costly and time consuming.

SUMMARY OF THE INVENTION

Therefore it is an object of this invention to provide an improved device for sealing well tubing which overcomes the above disadvantages and enables relatively safe, quick and inexpensive sealing and control of oil and gas well blowouts.

It is a further object of this invention to provide such a well sealing apparatus which may be remotely activated, thereby eliminating the need for divers or explosives.

It is a further object of this invention to provide a well sealing apparatus which quickly and effectively caps well blowouts thereby saving valuable oil and gas resources and reducing pollution of the surrounding environment.

It is a further object of this invention to provide a well sealing apparatus which reduces the chances of inadvertant activation, does not require high hydraulic pressures and provides for inexpensive, long-lasting repeated and troublefree operation.

It is a further object of this invention to provide a well sealing apparatus which may be employed with both land-based and offshore oil and gas wells.

This invention features an apparatus for sealing a well tubing (e.g. a well casing or production tubing) bore. A housing is provided which has channel means for communicating with the tubing bore and a chamber connected to the channel means. There are sealing means slidably mounted within the housing and disposable in a retracted open condition in the chamber to enable fluid flow through the channel means. An actuator disposed in the chamber includes a shape memory alloy material responsive to the temperature thereof rising to a predetermined level corresponding to the transition temperature of the shape memory alloy for transforming in shape to extend the sealing means into a sealing condition within the channel means, thereby blocking fluid flow through the tubing.

Also featured is a well sealing apparatus which includes a housing having channel means for communicating with the tubing bore and a plurality of chambers connected to the channel means, and typically extending therefrom in an axial plane. Each chamber includes actuator means which are slidably disposed in the housing and which are extended by heating of the actuator means to make sealing contact in the channel means.

In preferred embodiments of this invention, biasing means may oppose the actuator means and urge the sealing means into the retracted condition in the chamber. Such biasing means are overcome by heated shape transformation of the actuator.

Locking means may be provided for locking the sealing means in a closed condition when the actuator means is cooled to resume an untransformed shape. Release means may include a shape memory alloy material responsive to the temperature thereof rising to the transition temperatures of the shape memory alloy for transforming in shape to release the locking means and enable retraction of the sealing means when the actuator is cooled to resume its untransformed shape.

Connector means may be disposed in the chamber and reciprocally movable therein, and in such embodiments the actuator means are typically connected to one side of a connector element and the biasing means are connected to the other side of that element. An elongate member or other means may be joined to the side of the connector to which the biasing means are attached and preferably that member is extended axially through the chamber for carrying the sealing means at its opposite end. In such embodiments the means for locking may include first ratchet means disposed axially in the chamber, complementary second ratchet means opposing the first ratchet means, and radially resilient means connecting the first ratchet means and the slidably mounted connector and urging the second ratchet means toward the first ratchet means to enable the second ratchet means to slide over the first ratchet means as the sealing means is extended and lock with the first ratchet means when the actuator means is cooled to resume an untransformed shape.

Means may be provided for heating the shape memory material of the actuator to above its transition temperature. For example, an electric current may be run through the actuator. Alternatively, an exothermic chemical reaction may be effected in a compartment adjoining the actuator. In a preferred embodiment a transformer may be electrically connected to the actuator and to the release means to effect shape memory transformation. Although means for heating and activating the actuator are typically provided, the actuator may in some instances be activated by the heat of the well blowout fire itself where such fire spreads close enough to the device to cause shape transformation of the actuator.

Preferably the actuator includes one or two (concentric) helical springs and the biasing means includes a helical compression spring wound about the elongate member.

The transition temperature (e.g. the temperature at which shape transformation is fully effected) is typically above 75° C. and in any event is above the ambient oil temperature. Inlet means may be interconnected with the channel means below the chamber or chambers for enabling a sealing medium such as mud or cement to be introduced into the channel to enhance sealing.

The present invention is characterized by the provision of a thermally responsible actuator comprising a memory metal, i.e. an alloy which manifests the shape memory effect that changes shape when it passes from a low temperature phase to a higher temperature phase. Such alloys are well known, and they and the shape memory effect are discussed in, e.g., "Shape Memory Alloys", Scientific American, v. 281, pp. 74–82 (Nov. 1979), by L. McDonald Schetky.

The actuator in the form of helical coil spring is produced by initially winding it in its open coiled state so that the pitch is appropriate to 2% shear strain when the spring is compressed to its close coiled state. Following winding, the spring passes through a number of heat-treatment procedures, so as to give the spring its memory characteristics, after which the spring will contract to its close-coiled state at a temperature below the transformation, and on heating above the transformation it will expand axially to its open-coiled state.

The foregoing summary is only a brief description of the present invention. To increase the understanding of the mechanisms involved and their relationship to the shutoff device actuator under discussion, certain properties of the metals from which the spring actuator of the present invention may be made are described below.

Shape memory is a phenomenon exhibited by a number of alloys. However, to date, applications utilize the Ni-Ti type and Cu-based alloys. The important characteristics of these alloys is their ability to exist in two distinct shapes or configurations above and below a critical transformation temperature. Below the critical temperature a martensitic structure forms and grows as the temperature is lowered. When the temperature is raised the martensite shrinks and finally disappears. This change in metallurgical structure is linked with a change in dimensions and the alloy exhibits a memory of the high and low temperature shape. The transition transformation temperature can be varied by alterations to the alloy composition.

The general pattern of behavior is that a specimen deformed in the martensitic state completely regains its original, undeformed shape upon heating through the reverse transformation. For some time it has been realized that quite large forces or stresses are generated during the shape memory effect. For example, in NiTi alloys, stresses as high as 100,000 psi are created by the reverse transformation of the deformed martensite to the memory configuration during heating. Such stresses/forces are an order of magnitude higher than those necessary to deform the martensite at lower temperatures. Thus, heat can be used for the creation of a mechanical force, which can be used to do work. The principle involved is well illustrated in U.S. Pat. No. 3,403,238 disclosed by Buehler et al.

The characteristics described above illustrate the ability of the shape memory spring actuator to convert heat energy into mechanical work. Therefore, the shape memory spring can be used as a thermo-mechanical actuator to lift loads or more specifically to actuate the apparatus of the present invention to a closing position to stop the uncontrolled flow of fluids during drilling or production processes.

Examples of metallic materials which are capable of having the shape memory effect (SME), as described above, are the alloys disclosed in U.S. Pat. Nos: 3,783,037; 4,146,392; 4,274,872; and 4,282,033; and U.K. Pat. No. 1,346,047. However, it should be understood that the present invention is not limited to the use of any particular type of SME alloy, but rather contemplates the use of any SME alloy, whether now known or discovered in the future. The preferred alloys of the present invention are those made from a ternary alloy of copper, zinc, aluminum, or copper, aluminum, nickel, whose transformation tempertures above the temperature of fluids in an oil/gas well and below the coking temperature of the oil.

BRIEF DESCRIPTION OF THE DRAWING

The invention of the instant application will be more fully understood from the following description of the embodiment of the invention with reference to the drawing in which:

As shown in FIG. 1A, a well sealing apparatus $T_1$ is installed in an offshore oil or gas well production system. Apparatus $T_1$ is also suitable for installation on a drilled well or on a producing well at land locations. The offshore oil/gas well production system generally comprises a surface platform 10, a wellhead 11, and a production line or pipe string 12. Production line 12 usually consists of a plurality of pipe sections which may extend vertically from wellhead 11 to platform 10. However, for purposes of illustration only a single pipe string 12 is shown in FIG. 1A.

In general, an offshore drilling platform will be used to drill and operate numerous hydrocarbon producing wells. As illustrated in FIG. 1A, only a single well 13 is shown, but it should be understood that numerous wells connect to platform 10. Well 13 has a casing 14 extending to formations below the sea floor 15. Such formations produce hydrocarbons in a fluid form. Casing 14 is held in position in the sea floor 15 by cement 16. Platform 10 is located at a distance above the sea floor 15, such distance depending upon the depth of the water 17.

Connected to the top of wellhead 11 through connecting flange 18 is well sealing apparatus $T_1$. Connected to the upper part of apparatus $T_1$ is another connecting flange 19 through which pipe string 12 is connected.

Figure 1A:
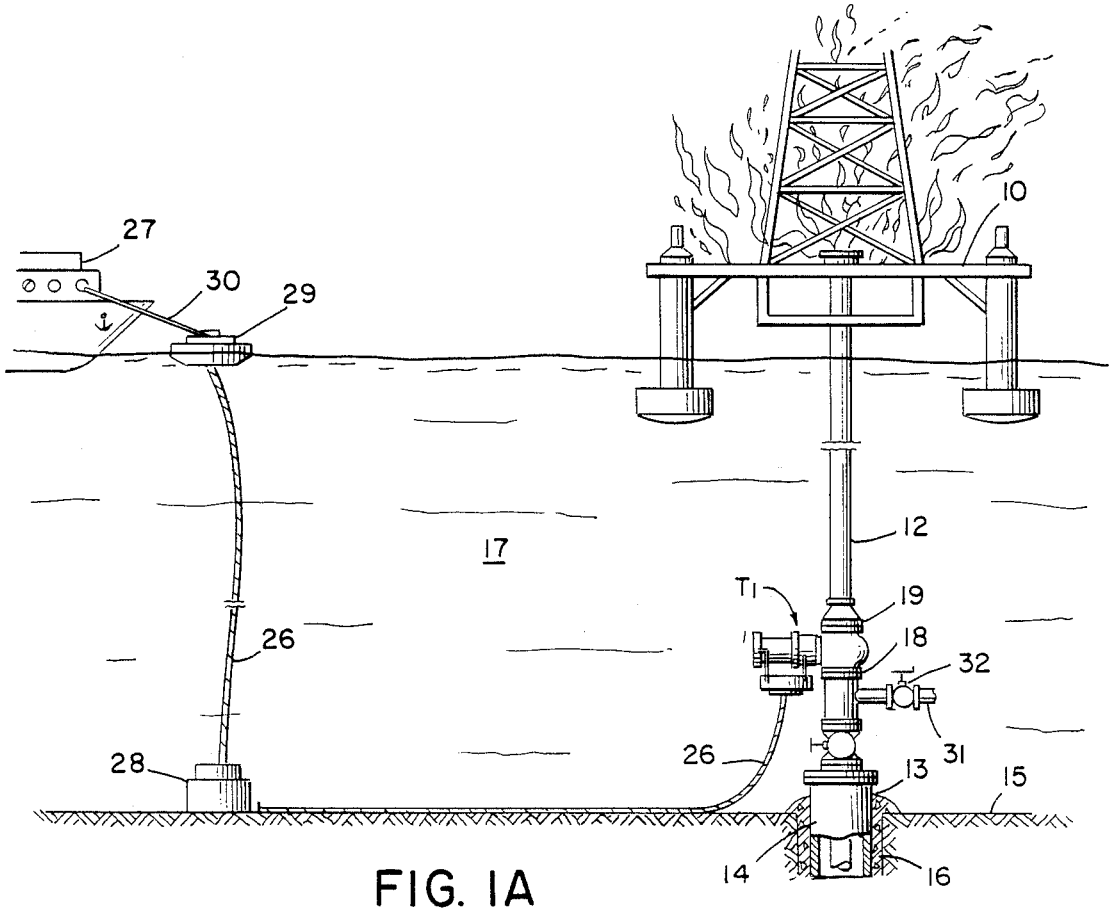
FIG. 1A is a schematic view of a preferred embodiment of the well closing/sealing apparatus constructed according to the present invention and positioned in an underwater well production system.

As can be seen in FIG. 1A, the platform has caught fire due to a blowout and any hydrocarbons flowing through pipe string 12 to platform 10 may add fuel to the fire in existence. It is therefore imperative to shut off all fluid flow through pipe string 12. By the use of apparatus $T_1$, flow through pipe string 12 may be stopped and the fire can be extinguished.

Figure 1B:
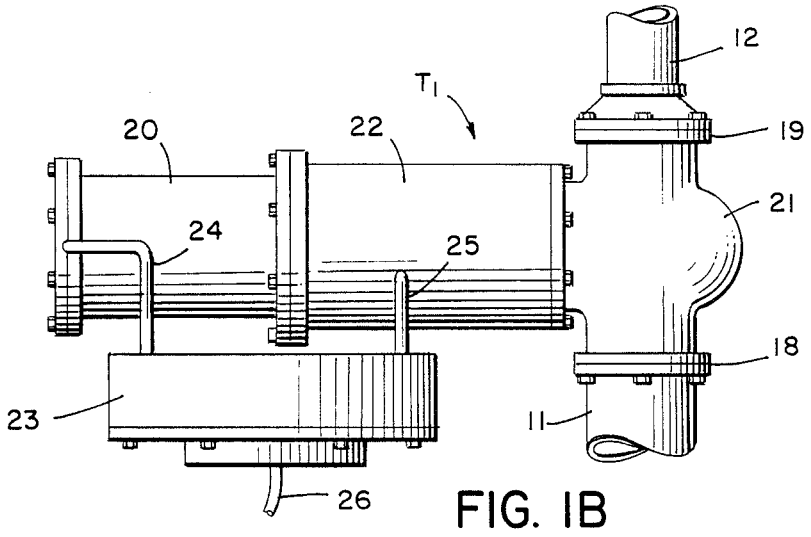
FIG. 1B is an elevational plan view of the closing apparatus shown in FIG. 1A.

As shown in FIG. 1B, apparatus $T_1$ has an actuator housing 20 connected to a seal housing 21 via a middle housing 22. Seal housing 21 is connected to wellhead 11 and pipe string 12 via connecting flanges 18 and 19. A transformer 23 is mounted on apparatus $T_1$ via connectors 24 and 25, respectively. Each connector contains an electric cable which will supply electric current from transformer 23 to apparatus $T_1$. The electric current supplied into transformer 23 is carried by a cable 26. As shown in FIG. 1A, the cable 26 is connected to a power generator in a ship 27. To prevent cable 26 from being moved to a closer location to the platform due to e.g. a water wave or a water stream, the connection is furnished with a fixed body 28 on the sea floor 15 and a floating panel 29 on the water surface. The fixed body 28 acts as an anchor while the floating panel 29 comprises electrical plugs which facilitate connecting the power supply from the ship 27 during operation.

In case of fire on the offshore drilling platform 10, ship 27 is sent to the floating panel 29. Thereafter, an operator in the ship 27 activates apparatus $T_1$ to close the well 13 by supplying electrical heat to the actuator of the apparatus. The heating time requires about 3 to 5 seconds in most cases to complete the closure. The operation of apparatus $T_1$ in controlling the blowout is not affected by either the length of cable 26 (the depth it is run) or by the pressures in the wellbore.

When the blowout is completely under control after closing apparatus $T_1$, the fluids in the well may then be directed through a flowline 31 to a desired location for storage. This flow is controlled by a valve 32 which may be operated manually from a remote location or by a diver.

Figure 2A:
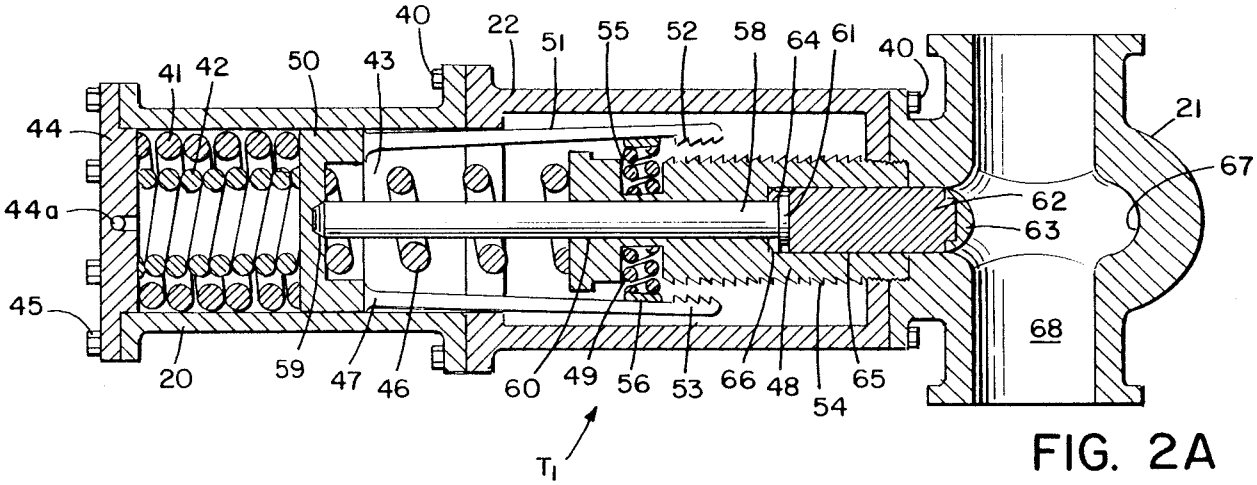
FIG. 2A is a cross sectional view of the apparatus shown in FIG. 1B in the opened position.
Figure 2B:
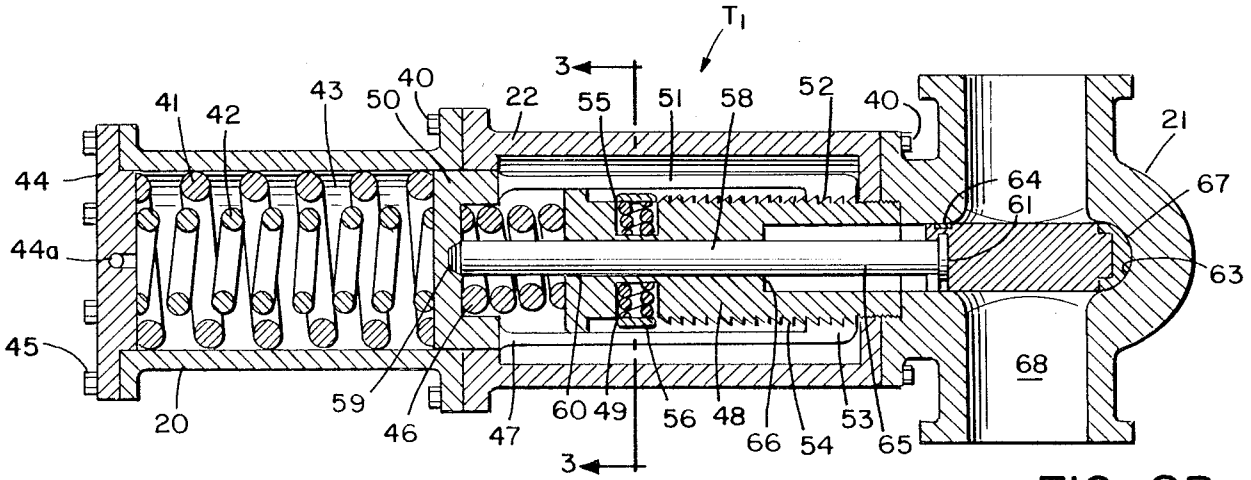
FIG. 2B is a cross sectional view of the well sealing apparatus of FIG. 1B in the closed position.

As shown in FIGS. 2A, 2B, a fluid-conducting channel 68 extends through housing 21 and a chamber 43 through housings 20 and 22 communicates with 21. These three housing components are connected by means of a plurality of fasteners 40.

A connector ring 50 is slidably mounted within chamber 43. An elongate member 58 is threadably attached at 59 to ring 50 and a seal 62 is attached at end 61 of member 58. Member 58 and seal 62 extend axially through chamber 43 and in particular are slidably disposed in the bore 60 of an axially arranged ratchet cylinder 48. Element 48 is itself threadably secured to housings 21 and 22 proximate the junction thereof.

Figure 4:
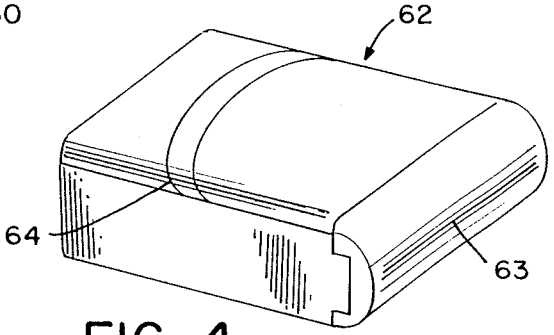
FIG. 4 is an isometric view of the sealing member.

Seal 62, shown alone in FIG. 4, has sealing surfaces 63 and 64 which are employed to provide sealing engagement with the inner wall of the housing 21. As seen in FIGS. 2A and 2B, an opening 65 is provided through ratchet cylinder 48 and the housing 21 for slidably accommodating seal 62. Stop means comprising the left edge 66 of opening 65 and a right edge 67 of the inner wall of the housing 21, are provided to limit the movement of the seal 62 once it has reached a fully open position, FIG. 2A, or a fully closed position, FIG. 2B.

Biasing means including a helical compression spring 46 urge seal 62 into a retracted condition, FIG. 2A, within chamber 43. One end of spring 46 engages ratchet cylinder 48 and the other end bears on ring 50.

A temperature-responsive shape memory actuator consists of two helical coil springs 41 and 42 which are positioned in a concentric nested form. Springs 41 and 42 provide an enhanced closing force. The total force exerted by the two springs of the actuator is equal to a summation of loads of each spring. In particular cases a single spring may be used. The actuator is disposed in chamber 43. One end of each spring 41, 42 is engaged by an end plate 44. End plate 44 seals the chamber 43 through application of a plurality of fasteners 45. The other ends of springs 41 and 42 engage connector ring 50. Springs 41 and 42 are heated by passing through them an electrical current, which is supplied from transformer 23 via cable 24 extending through opening 44a of plate 44.

Upon application of an electric current to the actuator, as shown in FIG. 2B, springs 41 and 42 are heated and transform into an expanded condition, bearing on ring 50 and urging bias spring 46 into its close coiled shape. Seal 62 is then extended to enter channel 68 and seal the well. The force stored by the bias spring 46 during the closing operation may be later utilized to open the seal during an opening operation.

Figure 3:
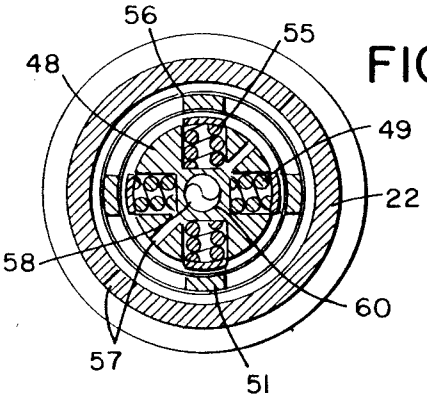
FIG. 3 is a view in section taken generally along the line 3—3 of FIG. 2B.

A locking system includes a control cage 47, ratchet cylinder 48 and a plurality of control springs 49. The control cage 47 interfaces with ring 50, so that it can transfer the load applied from either the expanding shape memory actuator or from the deflected bias spring 46. Ring 50 has four flexible finger members 51. Each flexible finger member 51 normally flexes inwardly, and has a series of circumferential ratchet teeth 52 at its head 53. Head 53 through its teeth 52 ratchets along cylinder 48. This ratchet cylinder 48 has circumferential ratchet teeth 54 which are used to engage head 53. Ratchet cylinder 48 is provided with four bore holes 55 wherein radial springs 49 are placed. Each control spring 49 has a guide plate 56 which is in contact with flexible finger member 51 during an opening operation. The arrangement of the four springs 49 with other control components, as described above, is depicted in FIG. 3. This figure shows the four springs 49 being fully contracted during a closing operation. Drilled holes 57 made in cylinder 48 and in housing 22 are used to insert a cable for supplying electric current to induce heat on the springs 49 during the opening operation.

Referring to FIGS. 1–4, apparatus $T_1$ is closed as follows: In the event of fire due to a blowout, the springs 41 and 42 of the actuator are heated as described above. This causes the actuator to expand and move in the right-hand direction. The force exerted by the expanding actuator is utilized to close the apparatus. As such force is applied through ring 50, spring 46 is compressed into its closed coiled shape so that rod 58 extends seal 62 to close bore 68. As cage 47 moves into the sealing position together with rod 58, finger members 51 are also moving to the right. Radial springs 49 are contracted (untransformed) and ratchet teeth 52 slide over ratchet teeth 54. Upon completion of the closing operation, FIG. 2B, teeth 52 rest on teeth 54 of cylinder 48. Control cage 47 is thus locked onto cylinder 48. Even when electrical heat to the actuator is switched off and springs 41 and 42 drop below the transition temperature and resume their initial closed coil shape, ring 50, rod 58 and seal 62 remain locked in the closed condition. As most clearly shown in FIG. 2B, those elements cannot move to the left and the apparatus continues to block fluid flow through the well.

To open apparatus $T_1$, electrical heat is transmitted through the transformer 23 to the control springs 49 which are also made of a shape memory alloy. The electric current from the transformer 23 is circulated through cable 25 following opening 57. With increasing temperature, the control springs 49 expand and move the guide plates 56 into contact with flexible finger members 51. The force exerted by each spring 49 lifts flexible finger members 51, causing ratchet teeth 52 of head 53 to disengage from teeth 54 of ratchet cylinder 48. This causes the bias spring 46 to expand and move in a left-hand direction into the condition of FIG. 2A). At the same time rod 58 is urged to draw seal 62 into an open position. The heating time to the control springs 49 during this opening operation is about 3–5 seconds in most cases. By switching the power off, the springs 49 cool down and return to their initial closed coiled shape. As the springs 49 contract, flexible finger members 51 also move inwardly toward the ratchet cylinder 48. Teeth 52 of finger members 51 thus rest on teeth 54 of ratchet cylinder 48. Apparatus $T_1$ may thus be reactivated when needed.

Figure 5:
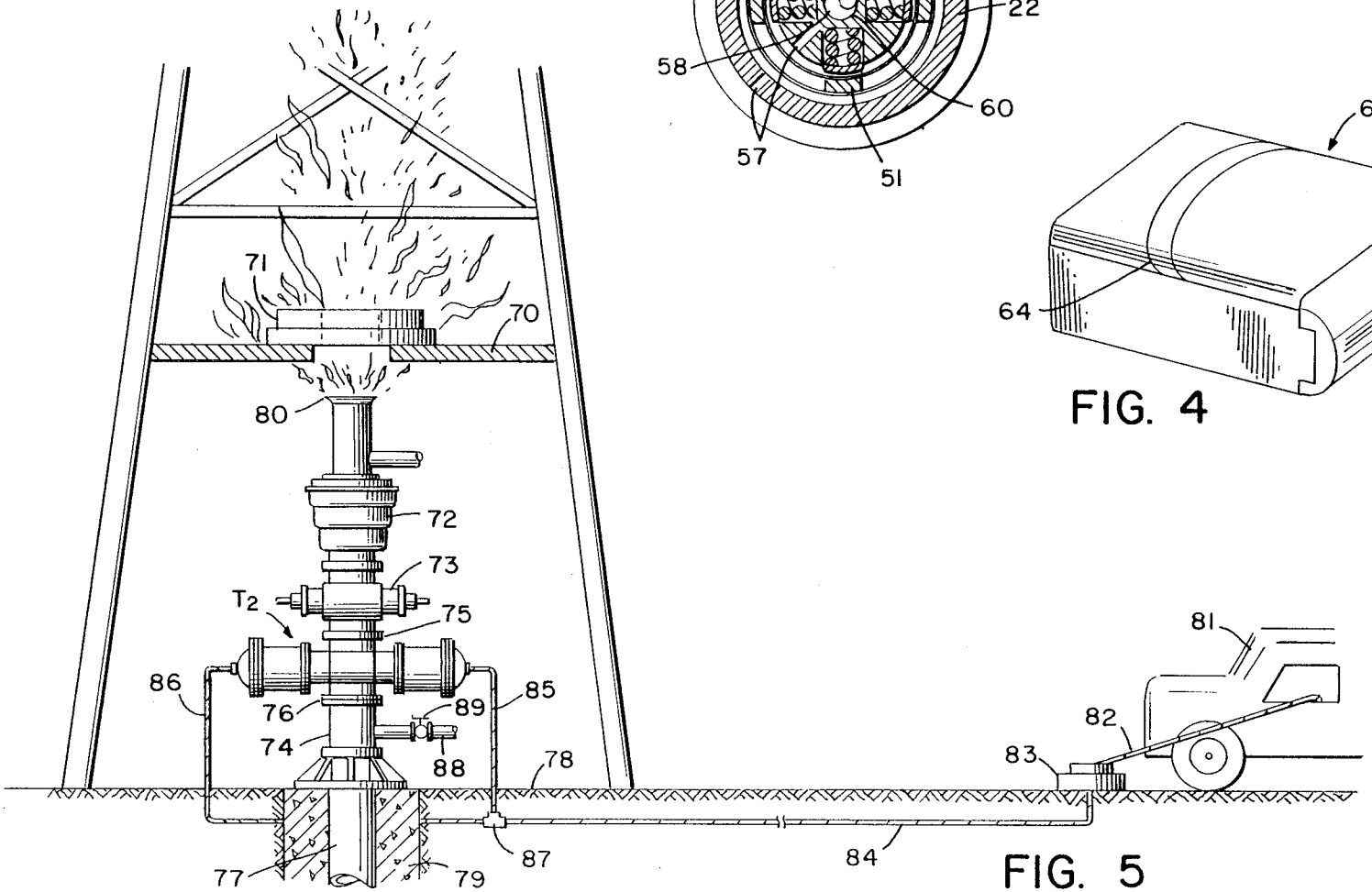
FIG. 5 is a schematic view of an alternative embodiment of the apparatus constructed according to the present invention with a conventional blowout preventer system and associated well head of a land based drilling rig.

Referring now to FIG. 5, another closing apparatus $T_2$ constructed in accordance with the present invention is illustrated. Apparatus $T_2$ is ideal for installation in wells on land, as well as wells positioned in the ocean. For purposes of illustration, FIG. 5 shows apparatus $T_2$ mounted for utilization in the drilling of an oil or a gas well on a land location. The oil/gas well drilling rig includes generally a rig floor 70 with a rotary table 71 mounted thereon, a conventional blowout preventer stack which consists of an annular blowout preventer 72 and one or more ram type blowout preventers 73, and a wellhead 74. Apparatus $T_2$ is mounted below the blowout preventer stack by means of a connecting flange 75 and above wellhead 74 by means of connecting flange 76. The drilled well has a casing 77 which is disposed within the wellbore and extends from the surface 78 to a subsurface drilled formation (not shown). Casing string 77 and associated wellhead 74 are supported and held in position in earth surface 78 by cement 79. Note that production of oil and gas has not yet commenced and that no production tubing is yet in casing 77.

Wellbore 80 is open at the top and the blowout preventer stack is inoperative as a result of equipment malfunction, or the like. A blowout has thus occurred and the well has caught fire. To extinguish the fire, the uncontrolled flow of fluids must first be stopped. Thereafter, the plugging operation is performed and the well may then be repaired or abandoned as desired.

Figure 6A:
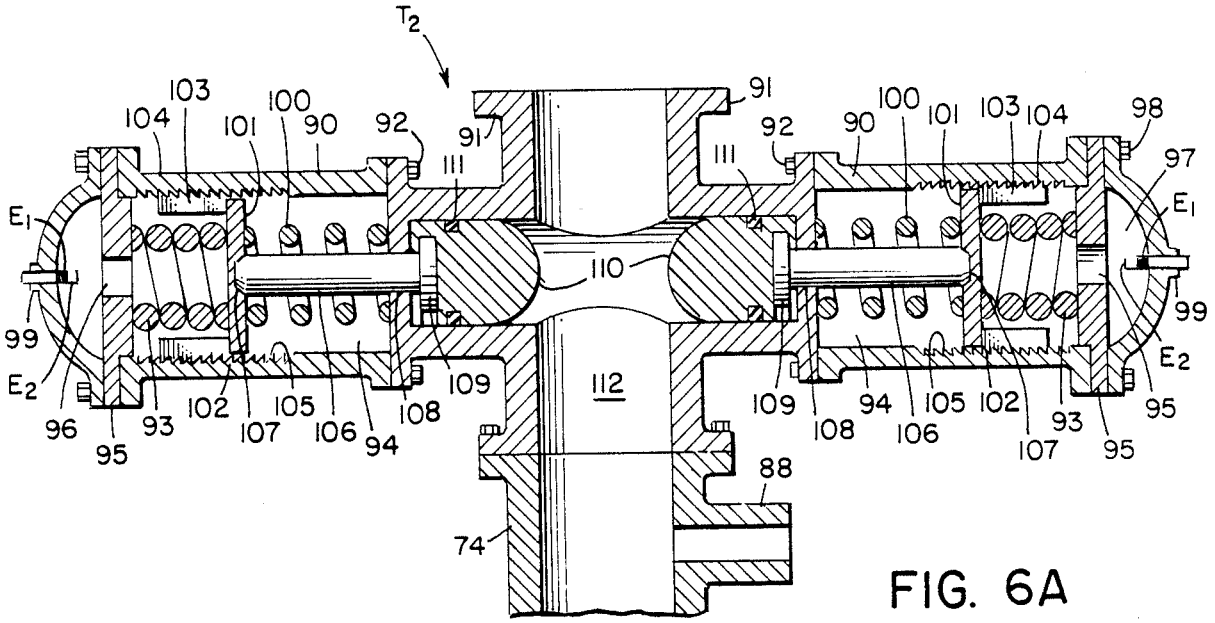
FIG. 6A is a cross sectional view of the apparatus shown in FIG. 5 in the opened position.
Figure 6B:
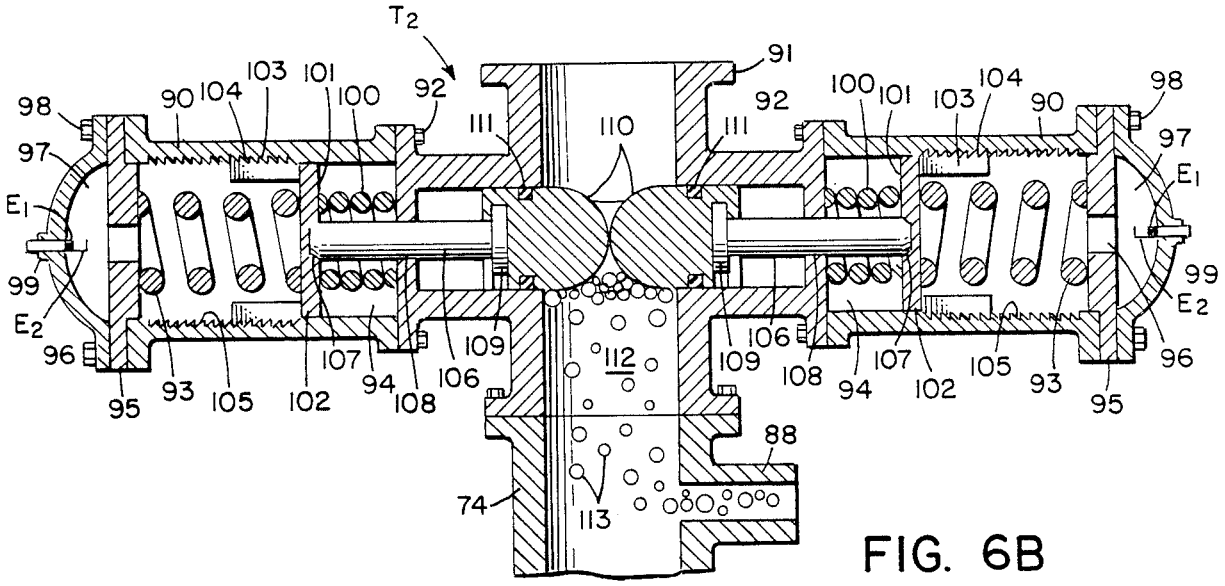
FIG. 6B is a cross sectional view of the apparatus of FIG. 5 in the closed position.

As shown in FIGS. 6A and 6B, apparatus $T_2$ includes the housing having two actuator housing portions 90 and a housing portion 91 having a channel 112 in communication with the bore of wellhead 74. These housing portions are connected by means of a plurality of fasteners 92.

A temperature-responsive shape memory actuator 93 in the form of a helical coil spring is disposed in the chamber 94 of each housing portion 90, 91. Although in FIGS. 6A and 6B only a single spring is used in each chamber, in particular cases, two or more springs may be employed to provide a greater load carrying capacity and closing force. One end of each spring 93 is engaged by an end plate 95 and the other end engages a slidable connector ring 101. End plate 95 has an opening 96 which communicates with a combustion compartment 97. A combustible chemical compound such as $Al_2O_3$ or a thermite mixture is provided in each compartment 97. Housing portion 90, end plate 95 and combustion compartment 97 are connected by means of a plurality of fasteners 98. Combustion compartment 97 includes a conduit 99 through which an electric cable is connected for purposes of ignition. The cable is connected to spark producing electrodes $E_1$ and $E_2$.

A helical compression spring 100 extends between slidable connector ring 102 and the wall of housing portion 91 and urges ring 102 toward compartment 97.

Figure 7:
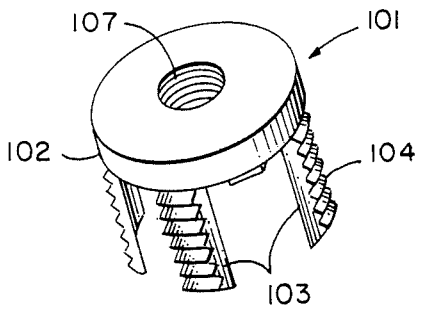
FIG. 7 is an isometric view of the locking cage assembly of the apparatus shown in FIG. 6.
Figure 8:
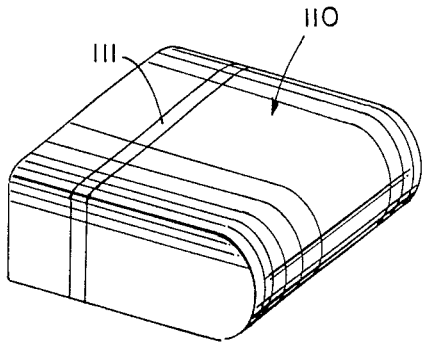
FIG. 8 is an isometric view of the sealing member of the apparatus shown in FIG. 6.

Apparatus $T_2$ is designed with a lock closing mechanism. This mechanism is provided by a ratcheting assembly which includes a locking cage 101 (illustrated along in FIG. 7). Locking cage 101 includes ring 102 and four arms 103 flexibly attached to ring 102. Each arm 103 has ratchet teeth 104 which can ratchet on teeth 105 of housing portion 90. Locking cage 101 interfaces with actuator 93 and bias spring 100 through ring 102. An actuating rod 106 extends through spring 100 and is connected at one end to ring 102 of locking cage 101 by means of threads 107. Actuating rod 106 maintains sliding engagement within a slideway 108 provided through valve housing 91. Rod 106 is connected at its other end 109 to a sealing element 110. Opposing seals 110 are used to close the wellbore. Each seal is associated with a respective housing portion 90, 91 and chamber thereof. As clearly shown in FIG. 8, seal 110 includes a sealing surface 111.

In operation, apparatus $T_2$ operates as follows.

As shown in FIG. 5, electrical energy is provided to each combustion compartment by the battery of a truck 81, which is parked at a location remote from the blowout. The battery is connected through a cable 82 to a control panel 83. A cable 84 is connected to panel 83 and is itself connected via tee 87 to cables 85, 86 leading into respective compartments 97 attached to housing portions 90, 91. Electric current is delivered to each combustion chamber 97, threby generating a spark across electrodes $E_1$, $E_2$ to ignite the chemical contents therein. The contents undergo rapid oxidation and the heat produced is communicated almost instantaneously to the chambers 94 via the openings 96. This increases the tempeature of the actuators 93 so that they expand and push cages 101 toward housing 91. The high forces exerted by actuators 93 push rods 106 and therefore the seals 110 into their closed positions in channel 112. The actuating force causes bias spring 100 to be compressed into its close coiled shape (see FIG. 6B). As cages 101 move into their closed positions together with rods 106, the arms 103 are also moved in the same direction. Upon completion of the closing operation, arms 103 rest on teeth 105 of housings 90, 91. Under this condition, the locking cages 101 hold actuating rods 106 in their closed positions, even if the electrical current to the combustion chambers 97 is switched off. As shown in FIG. 6B the construction of ratchet 104 of the arms 103 and the teeth 105 of the housing portions 90, 91 permits arms 103 to ratchet toward the closing position, but prevents them from being ratcheted toward the opening position.

After the apparatus $T_2$ is activated, drilling mud, cement or other suitable plugging materials 113 can be pumped into wellbore 112 via line 88 in wellhead 74 to tightly seal the well and to stop the uncontrolled flow of fluids from the wellbore. If desired, mud with high density or the like is injected to the wellbore at a pressure which is sufficient to overcome the formation pressure. The mud flows down to the formation until the weight of the inserted mud is sufficient to overcome the formation pressure. Thereafter, the valve 89, FIG. 5, in the line 88 may be closed and the well may be repaired or abandoned, as desired.

Drilling mud or similar materials are preferably used for plugging the wellbore formation since the well can be cleaned and subsequently used for the production of hydrocarbon fluids after the installation of suitable controls at wellhead 74. In the event that cement or similar material is used, the formation is normally irreparably damaged and the well is permanently plugged.

Figure 9:
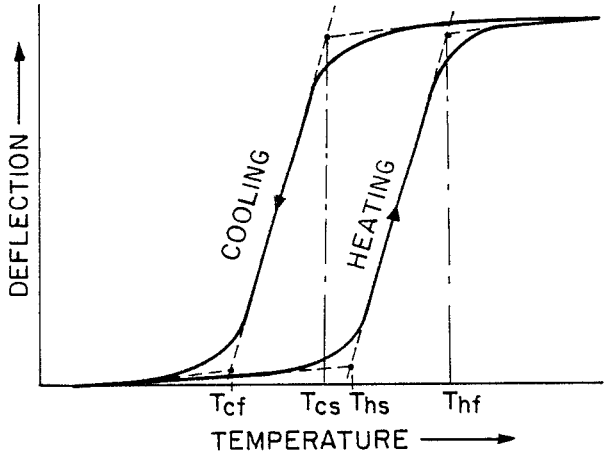
FIG. 9 is a diagrammatic view of the relationship of temperature versus deflection exhibited by the actuator.

The heating and cooling curves exhibited by actuators of the present invention are shown in FIG. 9. At a tempeature of $T_{hs}$ (approximately 75° C.) the actuator spring begins to deflect and close the seal. Full deflection and thus a fluid blocking seal is not completely effected until the actuator is heated to above $T_{hf}$ (approximately 100° C.). Martensitic cooling, and thus resumption of the retracted condition, commences when the temperature drops below approximately 60° C. and is completed at $T_{cf}$ (approximately 40° C.). It should be noted that the actuator typically loses its memory when heated to temperatures much above 200° C., thereby rendering the actuator unsuitable for reuse.

Figure 10:
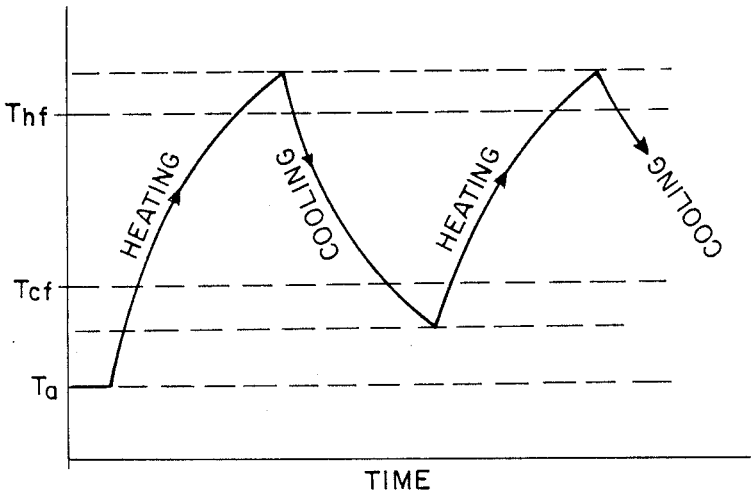
FIG. 10 is a diagrammatic view of the relationship of time versus temperature which may be exhibited by the actuator.

As shown in FIG. 10, the actuator is actually heated to slightly above and cooled to slightly below its respective heated and cooled shape transformation temperatures $T_{hf}$ and $T_{cf}$ in order to overcome the hysteresis of the spring actuators. Both such temperatures are typically above the ambient temperature $T_a$. The speed at which shape transformation occurs is a function of the composition and shape of the actuator, the current or heat provided thereto, and the environment (e.g. downhole pressures encountered by the actuator).

Either of the above embodiments may be remotely activated by personnel unable to reach the wellhead due to blowout or falling debris. Each may be employed with runaway wells on land as well as at offshore locations.

The simplicity and convenience of the embodiment of FIGS. 1–4 make its use desirable for capping blowouts of production wells such as shown in FIG. 1. However, the time required to heat two concentric actuator springs to the transition temperature may be undesirably great. Therefore, if the downhole pressures encountered by the seal are not too great a single spring may be preferred.

In drilling applications such as in FIG. 5, before production tubing has been installed in the casing and before production has commenced, much greater pressures are typically encountered. The multiple chamber embodiment of FIGS. 5–8 provides more spring force (e.g. as many as four helical springs) to oppose these downhole pressures. Thie embodiment is thus preferred in drilling operations.

What is claimed is:

1. Apparatus for sealing a well tubing bore comprising:

a housing including channel means for communicating with said tubing bore and a chamber connected to said channel means;

sealing means slidably mounted within said housing and disposable in a retracted open condition in said chamber to enable fluid flow through said channel means; and actuator means disposed in said chamber and including a shape memory alloy material responsive to the temperature thereof rising to a predetermined level corresponding to the transition temperature of said shape memory alloy for transforming in shape to extend said sealing means into a sealing contact within said channel means thereby blocking fluid flow therethrough; said channel means including a concave portion and said sealing means including a distal end having a complementary convex surface for conformably fitting said concave portion when said sealing means are extended.

2. Apparatus for sealing a well tubing bore comprising:

a housing including channel means for communicating with said tubing bore and a chamber connected to said channel means;

sealing means slidably mounted within said housing and disposable in a retracted open condition in said chamber to enable fluid flow through said channel means;

actuator means disposed in said chamber and including a shape memory alloy material responsive to the temperature thereof rising to a predetermined level corresponding to the transition temperature of said shape memory alloy for transforming in shape to extend said sealing means into a sealing contact within said channel means thereby blocking fluid flow therethrough; and means for locking including first ratchet means disposed axially in said chamber, complementary second ratchet means opposing said first ratchet means, radially resilient means connecting said second ratchet means to said first side of said slidable connector and urging said second ratchet means to slide over said first ratchet means as said sealing means is extended and lock with said first ratchet means when said actuator means is cooled to resume an untransformed shape.

3. Apparatus in accordance with either of claims 1 or 2 wherein said actuator means includes spring means.

4. Apparatus in accordance with either of claims 1 or 2 further including biasing means which oppose said actuator means and urge said sealing means into said retracted condition in said chamber and which are overcome by heated shape transformation of said actuator means to allow exension of said sealing means.

5. Apparatus in accordance with claim 4 wherein said biasing means include helical spring means.

6. Apparatus in accordance with claim 1 further including means for locking said sealing means in said extended condition when said acuator means is cooled to below said transition temperature.

7. Apparatus in accordance with either of claims 6 or 2 further including release means which include a shape memory alloy material responsive to the temperature thereof rising to the transition temperature of said shape memory alloy for transforming in shape to release said locking means and enable retraction of said sealing means when said actuator means is cooled to resume an untransformed shape.

8. Apparatus in accordance with either of claims 1 or 2 further including means for selectively heating said actuator means to said transition temperature.

9. Apparatus in accordance with claim 8 wherein said means for heating include means for providing an electrical current through said actuator.

10. Apparatus in accordance with claim 9 in which said means for providing an electrical current include a transformer and means for electrically connecting said transformer and said actuator means.

11. Apparatus in accordance with claim 8 wherein said means for heating includes means for generating an exothermic chemical reaction.

12. Apparatus in accordance with claim 11 wherein said means for generating includes a combustion compartment in thermal communication with said chamber and containing a combustible medium and means for igniting said medium.

13. Apparatus in accordance with claim 4 further including connector means disposed in said chamber and reeciprocally movable therein for interconnecting said sealing means with both said actuator means and said biasing means.

14. Apparatus in accordance with claim 3 wherein said actuator means include a pair of concentric helical springs.

15. Apparatus in accordance with claim 13 wherein said connector means include a connector element slidably disposed in said chamber and having a first side for engaging said actuator means and a second side for engaging said biasing means and an elongate member connecting said sealing means and said connector element.

16. Apparatus in accordance with claim 1 further including first ratchet means disposed axially in said chamber, complementary second ratchet means opposing said first ratchet means, radially resilient means connecting said second ratchet means to said first side of said slidable connector and urging said second ratchet means toward said first ratchet means to enable said second ratchet means to slide over said first ratchet means as said sealing means is extended and lock with said first ratchet means when said actuator means is cooled to below said transition temperature.

17. Apparatus in accordance with claim 9 wherein said transition temperature is greater than 75° C.

18. Apparatus in accordance with claim 7 further including means for heating said release means and said actuator means to said transition temperaure including a transformer and means for electrically connecting said transformer to said actuator means and release means.

19. Apparatus in accordance with claim 2 wherein said channel means includes a concave portion and said sealing means includes a distal end having a complementary convex surface to conformably fit said concave portion when said sealing means are extended.

20. Apparatus in acordance with either of claims 1 or 2 further including inlet means interconnected to said channel means below said chamber for enabling introduction of a sealing medium into said channel means.

21. Apparatus for sealing a well tubing channel comprising:

a housing including channel means for communicating with said tubing channel and a plurality of chambers connected to said channel means;

a plurality of sealing means slidably mounted within said housing, each being disposable in a retracted open condition in a respective chamber to enable fluid flow through said channel means; and actuator means disposed in each said chamber and including a shape memory alloy material responsive to the temperature thereof rising to a predetermined level corresponding to the transition temperature of said shape memory alloy for trnsforming in shape to extend an associated sealing means in said chamber into sealing contact with each other extended sealing means within said channel means thereby blocking fluid flow therethrough said channel means including a concave portion and said sealing member, including a distal end having a complementary convex surface for comformably fitting said concave portion when said sealing means are extended.

22. Apparatus for sealing a well tubing bore comprising:

a housing including channel means for communicating with said tubing bore and a chamber connected to said channel means;

sealing means slidably mounted within said housing and disposable in a retracted open condition in said chamber to enable fluid flow through said channel means;

actuator means disposed in said chamber and including a shape memory alloy material responsive to the temperature thereof rising to a predetermined level corresponding to the transition temperature of said shape memory alloy for transforming in shape to extend said sealing means into a sealing contact within said channel means thereby blocking fluid flow therethrough;

biasing means which oppose said actuator means and urge said sealing means into said retracted condition in said chamber and which are overcome by heated shape transformation of said actuator means to allow extension of said sealing means;

a connector element slidably disposed in said chamber and having a first side for engaging said actuator and a second side for engaging said biasing means and an elongate member connecting said sealing means and said connector element; and means for locking said sealing means in said extended condition when said actuator means is cooled to below said transition temperature including first ratchet means disposed axially in said chamber, complementary second ratchet means opposing said first ratchet means, radially resilient means connecting said second ratchet means to said first side of said slidable connector and urging said second ratchet means toward first said ratchet means to enable said second ratchet means to slide over said first ratchet means as said sealing means is extended and lock with said first ratchet means when said actuator means is cooled to below said transition temperature.

23. Apparatus for sealing a well tubing channel comprising:

a housing including channel means for communicating with said tubing channel and a plurality of chambers connected to said channel means;

a plurality of sealing means slidably mounted within said housing, each being disposable in a retracted open condition in a respective chamber to enable fluid flow through said channel means;

actuator means disposed in each said chamber and including a shape memory alloy material responsive to the temperature thereof rising to a predetermined level corresponding to the transition temperature of said shape memory alloy for transforming in shape to extend an associated sealing means in said chamber into sealing contact with each other extended sealing means within said channel means thereby blocking fluid flow therethrough;

biasing means which oppose said actuator means and urge said sealing means into said retracted condition in said chamber and which are overcome by heated shape tranformation of said actuator means to allow extension of said sealing means;

a connector element slidably disposed in each said chamber and having a first side for engaging a said actuator and a second side for engaging a said biasing means and an elongate member connecting said sealing means and said connector element; and means for locking said sealing means in said extended condition when said actuator means is cooled to below said transition temperature including first ratchet means disposed axially in a said chamber, complementary second ratchet means opposing said first ratchet means, radially resilient means connecting said second ratchet means to said first side of a said slidable connector and urging said second ratchet means toward said first ratchet means to enable said second ratchet means to slide over said first ratchet means as said sealing means is extended and lock with said first ratchet means when said actuator means is cooled below said transition temperature.

24. Apparatus for sealing a well tubing channel comprising:

a housing including channel means for communicating with said tubing channel and a plurality of chambers connected to said channel means;

a plurality of sealing means slidably mounted within said housing, each being disposable in a retracted open condition in a respective chamber to enable fluid flow through said channel means; and actuator means disposed in each said chamber and including a shape memory alloy material responsive to the temperature thereof rising to a predetermined level corresponding to the transition temperature of said shape memory alloy for transforming in shape to extend an associated sealing means in said chamber into sealing contact with each other extended sealing means within said channel means thereby blocking fluid flow therethrough; and means for locking including first ratchet means disposed axially in said chamber, complementary second ratchet means opposing said first ratchet means, radially resilient means connecting said second ratchet means to said first side of said slidable connector and urging said second ratchet means to slide over said first ratchet means as said sealing means is extended and lock with said first ratchet means when said actuator means is cooled to resume an untransformed shape.

* * * * *